US006651899B2

(12) United States Patent
Xu et al.

(10) Patent No.: US 6,651,899 B2
(45) Date of Patent: Nov. 25, 2003

(54) CONTINUOUS CASTING NOZZLE WITH PRESSURE MODULATOR FOR IMPROVED LIQUID METAL FLOW REGULATION

(75) Inventors: Dong Xu, Ontario (CA); Lawrence J. Heaslip, Ontario (CA); James D. Dorricott, Ontario (CA)

(73) Assignee: Vesuvius Crucible Company, Wilmington, DE (US)

( * ) Notice: Subject to any disclaimer, the term of this patent is extended or adjusted under 35 U.S.C. 154(b) by 125 days.

(21) Appl. No.: 09/878,584

(22) Filed: Jun. 11, 2001

(65) Prior Publication Data

US 2001/0054650 A1 Dec. 27, 2001

Related U.S. Application Data

(60) Provisional application No. 60/213,773, filed on Jun. 23, 2000.

(51) Int. Cl.[7] ..... B05B 17/04; B05B 1/30; B05B 1/00; F02M 47/02; A62C 31/00

(52) U.S. Cl. ..... 239/11; 239/88; 239/533.1; 239/597; 239/589

(58) Field of Search ..... 239/11, 88, 266, 239/267, 268, 533.1, 533.3, 569, 583, 597, 601, 589; 266/44, 45, 236, 271, 239, 230

(56) References Cited

U.S. PATENT DOCUMENTS 3,689,047 A * 9/1972 Grosko ..... 266/208
3,729,118 A * 4/1973 Wernli et al. ..... 222/595
4,236,917 A * 12/1980 Dolzhenkov et al. ..... 75/680
5,020,778 A * 6/1991 Thibault et al. ..... 266/89
5,785,880 A * 7/1998 Heaslip et al. ..... 222/594
6,260,742 B1 7/2001 Caillaud et al.

FOREIGN PATENT DOCUMENTS

| | | |
|---|---|---|
| EP | 0 306 751 B | 3/1989 |
| EP | 0 726 113 B | 8/1996 |
| GB | 1 112 819 A | 5/1968 |
| JP | 08 294757 A | 11/1996 |
| JP | 11 320046 A | 11/1999 |

* cited by examiner

*Primary Examiner*—Davis Hwu
(74) *Attorney, Agent, or Firm*—James R. Williams; Robert S. Klemz

(57) ABSTRACT

A nozzle for transferring a flow of liquid metal between metallurgical vessels or molds comprising an entry portion for receiving the liquid metal. A flow regulator, such as a stopper rod, is movable from an open position to a closed position with respect to the entry portion for respectively permitting and prohibiting flow through the nozzle. The entry portion and the flow regulator define a control zone therebetween. A pressure modulator, downstream of the control zone, is adapted to minimize a pressure differential across the control zone. The pressure modulator constricts flow downstream of the control zone.

16 Claims, 11 Drawing Sheets

FIG.5
PRIOR ART
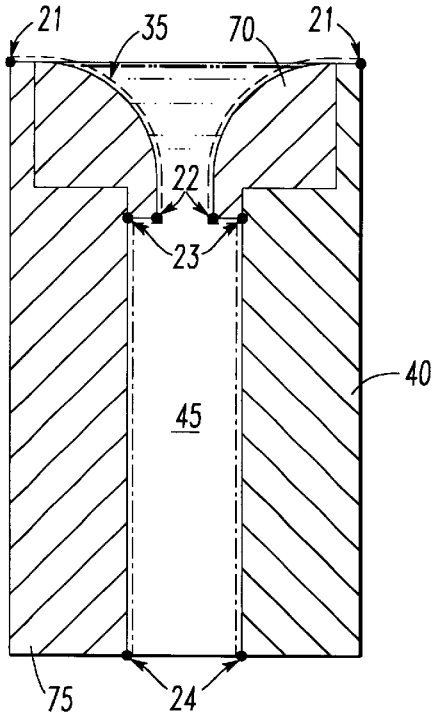
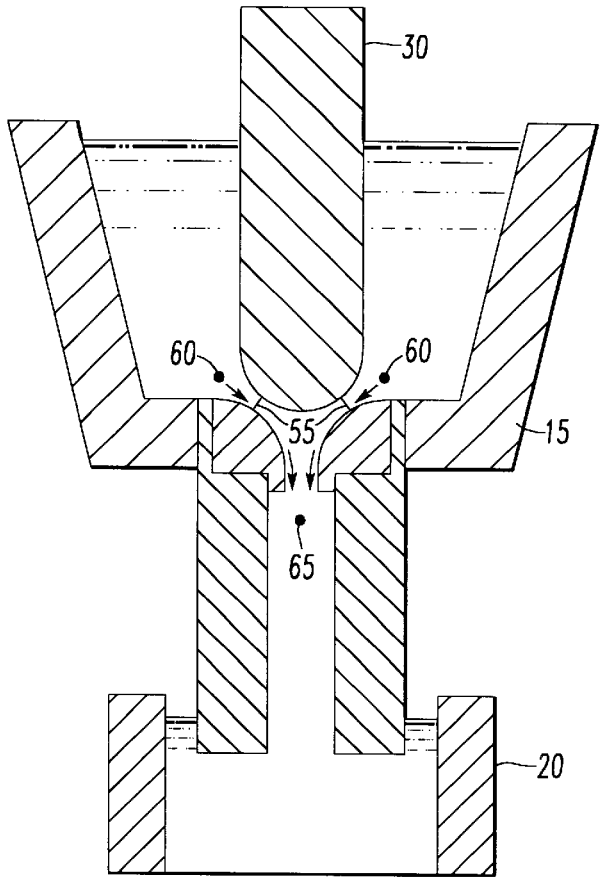
FIG.6
PRIOR ART
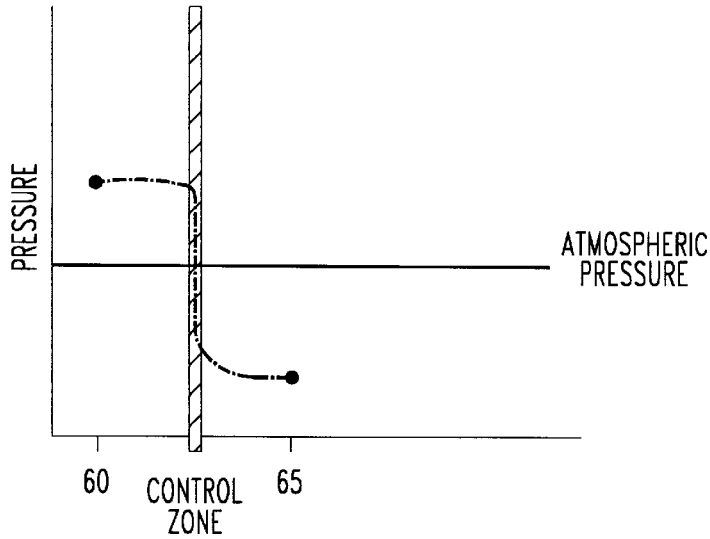
FIG.7

CONTINUOUS CASTING NOZZLE WITH PRESSURE MODULATOR FOR IMPROVED LIQUID METAL FLOW REGULATION

This Application claims the benefit of U.S. Provisional Application Serial No. 60/213,773, filed Jun. 23, 2000, the entire disclosure of which is incorporated herein by reference.

BACKGROUND OF THE INVENTION

During processing, liquid metals, and in particular liquid steel, flow from one vessel, such as a tundish, into another vessel, such as a mold, under the influence of gravity. A nozzle may guide and contain the flowing stream of liquid metal during passage from one vessel to another.

Controlling the rate of flow of the liquid metal during processing is essential. To this end, a regulator or flow controller allowing adjustment of the rate of liquid metal flow is used. A common regulator is a stopper rod, although any type of flow regulator known to those skilled in the art can be used. Thus, a typical continuous steel casting process allows liquid metal to flow from a tundish into a mold, through a nozzle employing a stopper rod for flow regulation.

Referring to FIG. 1, in such a typical continuous steel casting process, a tundish 15 is positioned directly above a mold 20 with a nozzle 25 connected to the tundish 15. A nozzle 25 provides a conduit through which liquid metal 10 flows from the tundish 15 to the mold 20. A stopper rod 30 in the tundish 15 controls the rate of flow through the nozzle 25.

FIG. 2 is a partial schematic view, drawn to an enlarged scale, of an entry portion and a lower portion 40 35 of a nozzle bore 45 of the nozzle 25 of FIG. 1. In FIG. 2, the entry portion 35 extends between points 1 and 2. The lower portion 40 extends between points 2 and 3. The entry portion 35 of the nozzle bore 45 is in fluid communication with liquid metal 10 contained in the tundish 15. The lower portion 40 of the nozzle bore 45 is partially submerged in liquid metal 10 in the mold 20.

Returning back to FIG. 1, to regulate the liquid metal flow rate from the tundish 15 into the mold 20, the stopper rod 30 is raised or lowered. For example, the flow of liquid metal 10 is stopped if the stopper rod 30 is lowered fully so that a nose 50 of the stopper rod 30 blocks the entry portion 35 of the nozzle bore 45. As the stopper rod 30 is raised above the fully lowered position, liquid metal can flow through the nozzle 25. The rate of flow through the nozzle 25 is controlled by adjustment of the position of the stopper rod 30. As the stopper rod 30 is raised, the nose 50 of the stopper rod 30 is moved farther from the entry portion 35 of the nozzle bore 45, which increases the open area between the stopper nose 50 and the nozzle 25 allowing a greater rate of flow.

FIG. 3 shows another liquid metal flow system from the tundish 15 to the mold 20. This system has a control zone 55 located between the nose 50 of the stopper rod 30 and the entry portion 35 of the nozzle bore 45. The control zone 55 is the narrowest part of the open channel between the stopper nose 50 and the entry portion 35 of the nozzle bore 45. Liquid metal 10 in the tundish 15 has a static pressure caused by gravity. If the stopper rod 30 does not block the entry of liquid metal 10 into the bore 45 of the nozzle, the pressure of liquid metal 10 in the tundish 15 forces liquid metal 10 to flow out of tundish 15 and into nozzle 25.

When the flow is less than the maximum, the characteristics of the open area of control zone 55 are primary factors in the regulation of the rate of flow into the nozzle 25 and subsequently into the mold 20.

FIG. 4 graphically shows changes in the pressure of liquid metal 10 flowing out of the tundish 15 through the control zone 55 and into the nozzle 25. As shown in FIG. 3, point 60 represents a general location within the liquid metal 10 contained in the tundish 15 upstream of the control zone 55. Point 65 represents a general location within the open bore 45 of the nozzle 25 downstream of the control zone 55. As shown in FIG. 4, the general trend in the pressure of liquid metal 10 between points 60 and 65 is a sharp drop in pressure across the control zone 55. The pressure at 60 is generally higher than atmospheric pressure. The pressure at 65 is generally less than atmospheric pressure, resulting in a partial vacuum.

FIG. 5 illustrates a two-component nozzle, including an entry insert 70 and a main body 75. The entry portion 35 of bore 45 extends from points 21 to 22 to 23, and the lower portion 40 extends from points 23 to 24.

FIG. 6 illustrates a liquid metal flow system, from tundish 15 to mold 20 and incorporates the nozzle of FIG. 5. FIG. 7 illustrates the pressure trend from point 60 to point 65 in the system of FIG. 6. The pressure trend for the system of FIG. 6 basically is the same as that for FIG. 3, including a sharp drop in pressure across control zone 55.

In summary, the nozzles of FIGS. 1, 3 and 6 cause a sharp pressure drop across the respective control zones. This sharp pressure drop causes the flow regulation system to be overly sensitive. An overly sensitive flow regulation system tends to cause an operator to continually hunt, or move the regulator to achieve the correct position so as to adjust the size and/or geometry of the control zone for flow stabilization at a desired rate. Hunting for the proper flow regulation causes turbulence in the entry portion 35 and throughout the bore 45 of the nozzle 25.

Turbulence caused by hunting and also by the partial vacuum/low pressure generated downstream of the control zone accelerate erosion around the control zone. For example, erosion of a nose 50 of a stopper rod 30 and an entry portion 35 of a nozzle bore 45 can occur. The highest rate of erosion generally occurs immediately downstream of the control zone 55. Erosion in and about the control zone 55 exacerbates difficulties associated with liquid metal flow rate regulation. Undesirable changes in the critical geometry of the control zone 55, as a result of erosion, lead to unpredictable flow rate variances, which ultimately can result in the complete failure of a flow regulation system.

Referring again to FIG. 5, for reducing erosion, hence improving flow regulation, in some nozzles the entry insert 70 is generally composed of an erosion-resistant refractory material. However, the addition of the entry insert 70 to the nozzle 40 does not affect the sharp pressure drop across control zone 55, as shown in FIGS. 4 and 7. Thus, flow regulation for conventional nozzles remains overly sensitive to regulator movements, due to the size and shape of the control zone defined thereby, making flow rate stabilization difficult to achieve.

Accordingly, a need exists for a nozzle that minimizes the pressure differential across a nozzle control zone, reducing the corrosive effects thereof and stabilizing the size and shape of the control zone, thereby reducing hunting and increasing flow stability.

SUMMARY OF THE INVENTION

The present invention fulfills the above-described need by providing a nozzle with a minimal pressure differential across a nozzle control zone, reducing the corrosive effects thereof and stabilizing the size and shape of the control zone, thereby reducing hunting and increasing flow stability.

To this end, the present invention includes a nozzle for controlling a flow of liquid metal including an entry portion for receiving the liquid metal. A regulator such as a stopper rod is movable from an open position to a closed position with respect to the entry portion for respectively permitting and prohibiting flow through the nozzle. The entry portion and the regulator define a control zone therebetween. A pressure modulator, downstream of the control zone, is adapted to minimize a pressure differential across the control zone. The pressure modulator constricts flow downstream of the control zone.

The invention diminishes the sharp pressure drop across the control zone by modulating the pressure in the nozzle downstream of the control zone, reduces the turbulence of the flow immediately downstream of the control zone, and eliminates over-sensitivity of flow regulation. The nozzle of the present invention can reduce erosion in the region of the control zone and stabilize flow regulation, which improves flow control and mold level control during continuous casting.

Other features and advantages of the present invention will become apparent from the following description of the invention, which refers to the accompanying drawings.

BRIEF DESCRIPTION OF THE DRAWINGS

FIG. 5 is a partial schematic view, drawn to an enlarged scale, of an alternative entry portion and lower portion of the nozzle bore of the prior art nozzle of FIG. 1;

FIG. 6 is a schematic view of a liquid metal flow system incorporating the nozzle of FIG. 5;

FIG. 7 is a graphical view of the fluid pressure of liquid metal flowing through the embodiment of FIG. 6;

DETAILED DESCRIPTION OF PREFERRED EMBODIMENTS

Figure 8:
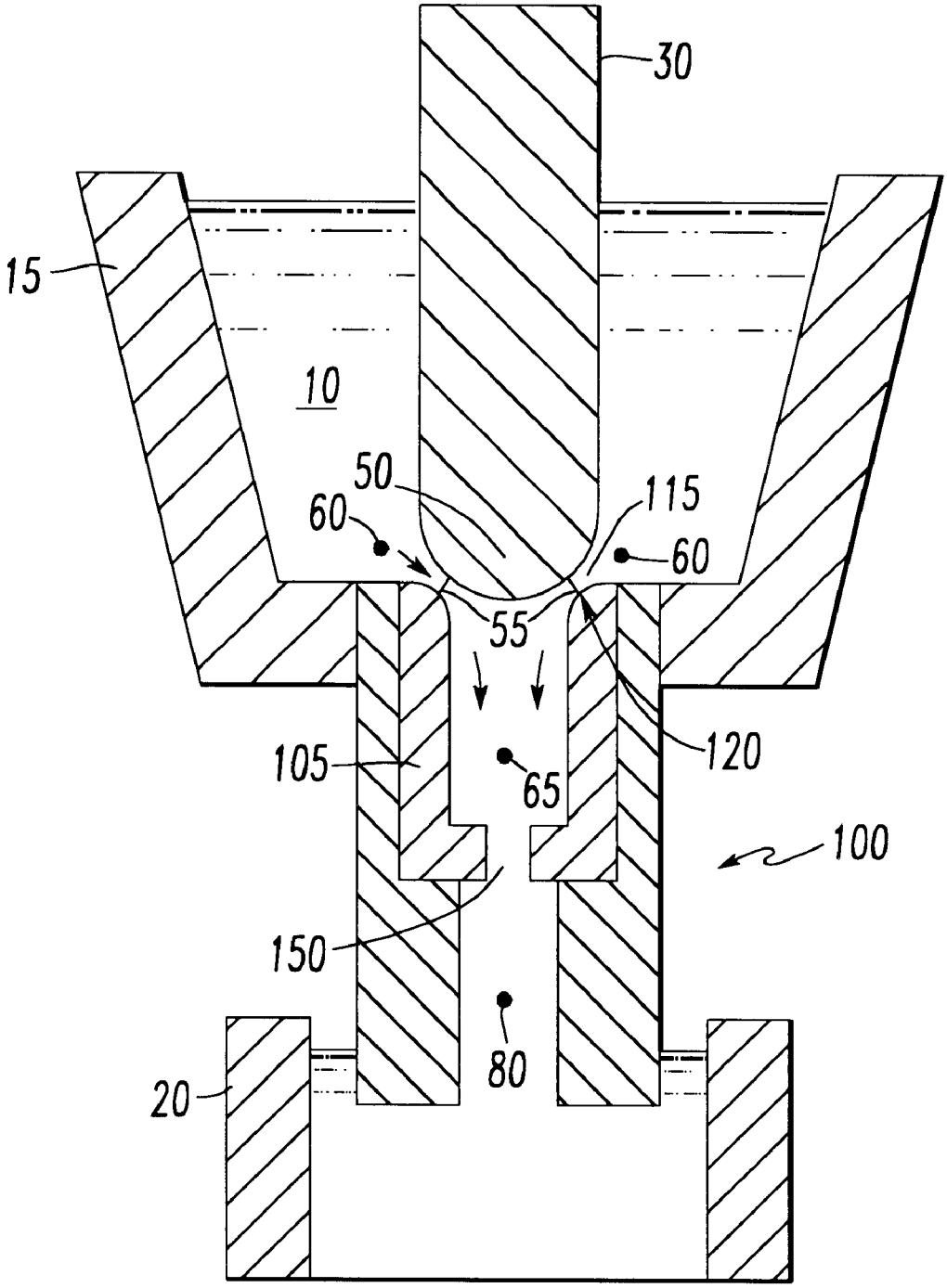
FIG. 8 is a schematic view of a liquid metal flow system incorporating a first embodiment of the continuous casting nozzle according to the present invention.
Figure 9:
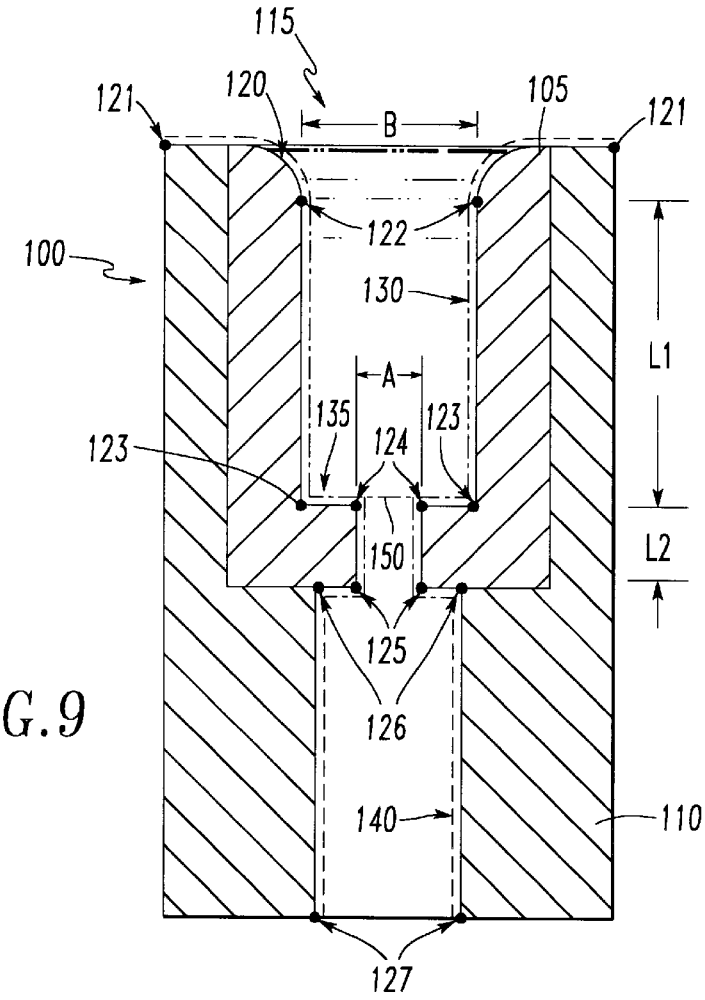
FIG. 9 is a partial schematic view, drawn to an enlarged scale, of the entry portion, pressure modulator and lower portion of the embodiment of FIG. 8.

FIGS. 8 and 9 show a first embodiment of the nozzle 100 of the present invention. FIG. 8 shows a liquid metal flow system, from a tundish 15 to a mold 20 that incorporates a nozzle 100. FIG. 9 shows an enlarged view of the nozzle 100.

Referring to FIG. 9, nozzle 100 includes two components: a pressure modulator entry insert 105 and a main body 110. The nozzle 100 has a bore 115 that is divided into three portions: an entry portion 120, extending from point 121 to point 122; a pressure modulator portion 130, extending from point 122 to point 123 to point 124 to point 125 to point 126; and a lower portion 140, extending from point 126 to point 127.

The pressure modulator 130 generates sudden, strong flow compression. The compression minimizes the pressure differential across the control zone of nozzle 100, as discussed below, reducing the corrosive effects thereof and stabilizing the size and shape of the control zone. This reduces hunting and increases flow stability.

Referring to FIG. 8, the nozzle 100 has a control zones 55 located between the nose 50 of a stopper rod 30 and the entry portion 120 of the nozzle bore 115 on opposite sides of the nose 50. One skilled in the art will appreciate that any known flow regulator can be used in place of the stopper rod 30.

Each control zone 55 is the narrowest part of the open channel between the entry portion 120 of the nozzle bore 115 and the stopper nose 50. In general, each control zone 55 is located above the pressure modulator portion 130 and is defined by any structure capable of modifying the control zone 55 and regulating liquid metal flow into the pressure modulator portion 130.

The pressure modulation of nozzle 100 is effected using a constriction zone. The liquid metal system of FIG. 8 has a constriction zone 150 located downstream of the control zone 55 of the nozzle 100. The constriction zone 150 is located across the narrow part of the nozzle bore 115, defined by a pressure modulator insert 105. If the stopper rod 30 does not block the entry portion 120 of the nozzle bore 115, opening the control zone 55 to allow flow, the pressure of the liquid metal 10 caused by gravity in the tundish 15 causes liquid metal 10 to flow out of the tundish 15 and into the nozzle 100. When the flow is less then the maximum, the characteristics of the open area of the control zone 55 are primary factors in flow rate regulation into the nozzle 100 and subsequently into the mold 20.

Figure 10:
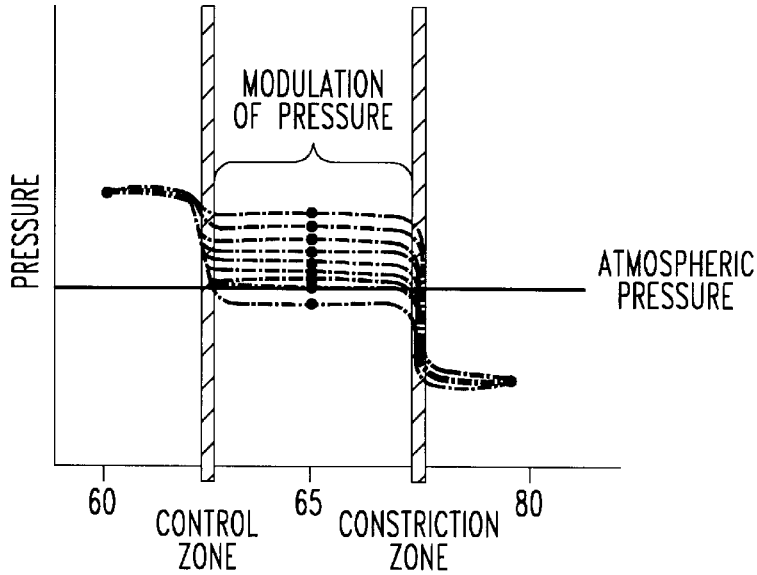
FIG. 10 is a graphical view of the fluid pressure of liquid metal flowing through the embodiment of FIG. 8.
Figure 11:
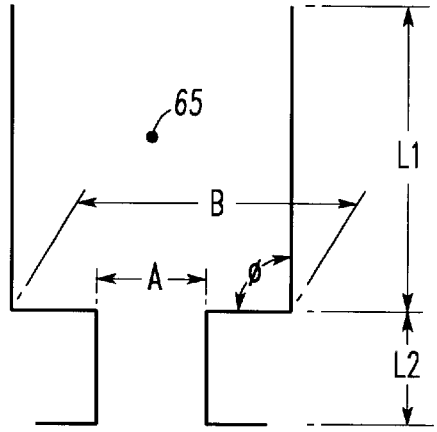
FIGS. 11–16 are schematic views of alternative pressure modulators for the embodiments of FIGS. 8 and 9.
Figure 12:
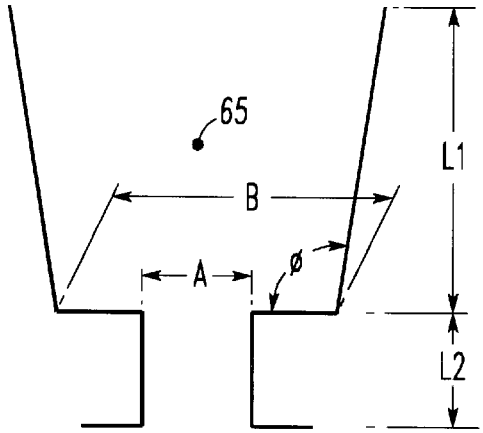

Changes in the pressure of the liquid metal 10 as it flows out of the tundish 15, through the control zone 55, and into the entry portion 120, of the nozzle 100, and then through the constriction zone 150 into the lower portion 140 thereof is illustrated schematically in FIG. 10. Point 60 represents a general location within the liquid metal contained in the tundish 15 upstream of the control zone 55. Point 65 represents a general location within the open bore of the nozzle downstream of the control zone 55, but upstream of the constriction zone 150 in the modulator portion 130 of nozzle bore 115. Point 80 represents a general location within the open bore of the nozzle downstream of constriction zone 150 in lower portion 140 of nozzle bore 115.

Figure 1:
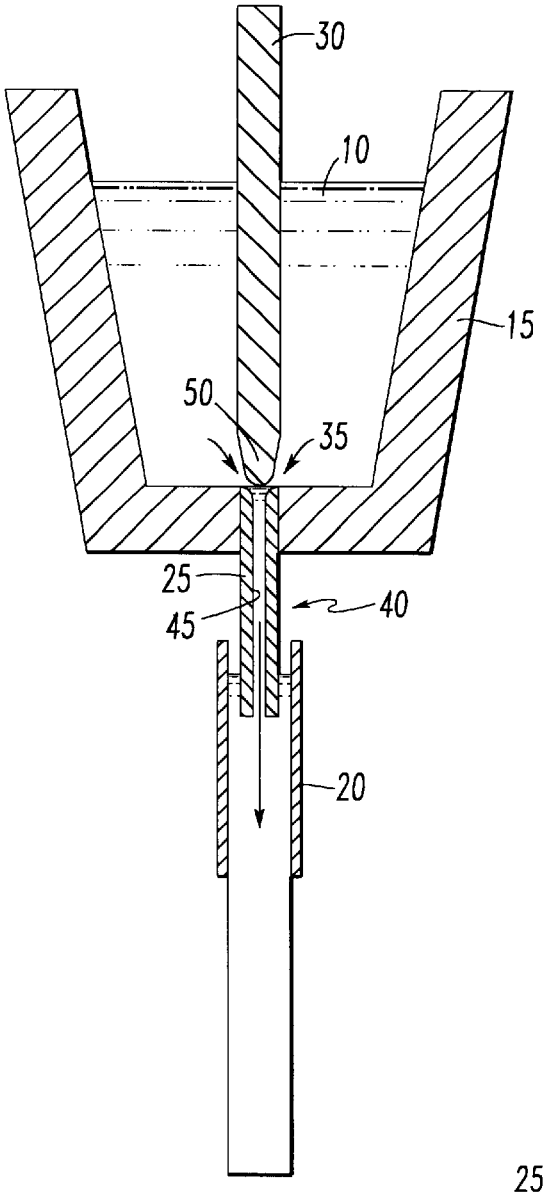
FIG. 1 PRIOR ART
FIG. 1 is a schematic view of a liquid metal flow system incorporating a prior art continuous casting nozzle.
Figure 2:
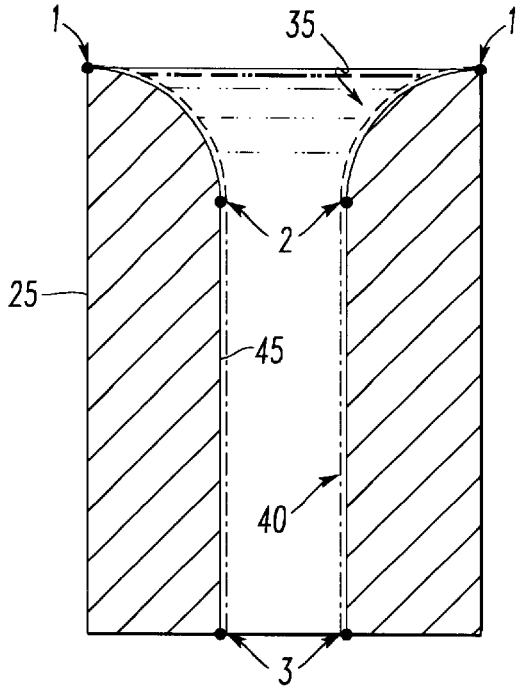
FIG. 2 PRIOR ART
FIG. 2 is a partial schematic view, drawn to an enlarged scale, of an entry portion and lower portion of the nozzle bore of the prior art nozzle of FIG. 1.
Figure 3:
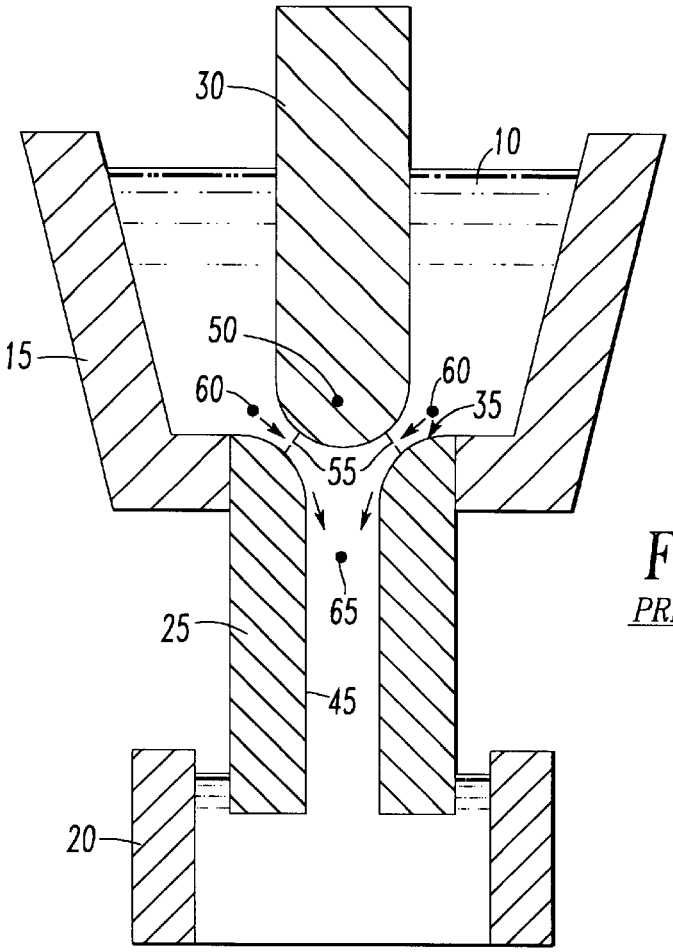
FIG.3 PRIOR ART
FIG. 3 is a schematic view of a liquid metal flow system incorporating a second prior art continuous casting nozzle.
Figure 4:
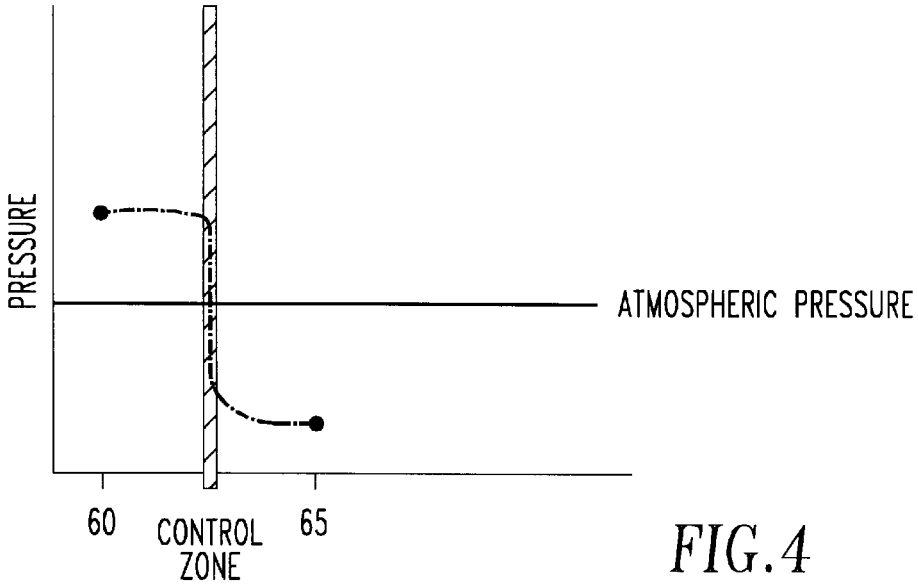
FIG. 4 is a graphical view of the fluid pressure of liquid metal flowing through the embodiment of FIG. 3.

As shown in FIG. 10, a small initial drop in pressure across the control zone 55 is followed by another drop in pressure across the constriction zone 150. Points 60 and 65 in FIGS. 8, 10, 17 and 19 are analogous to points 60 and 65 in FIGS. 3, 4, 6 and 7. Comparing FIG. 10 with FIGS. 4 and 7 demonstrates that the constriction zone 150 caused by the pressure modulator portion 130 reduces the magnitude of the pressure drop across the control zone 55. Thus, the pressure at point 65 is modulated such that the pressure drop across the control zone 55 is reduced.

Referring again to FIG. 9, pressure modulator 130 of nozzle 100 has design parameters A, B, L1 and L2. For simplicity, FIGS. 11–16 show wireform schematic views of various configurations derived from altering the foregoing parameters. "A" is the size of the constriction zone. "B" is the size of the open channel in pressure modulator portion 130 of the bore at or immediately upstream of the constriction zone. "L1" is the length of the pressure modulator above the constriction. "L2" is the length of the constriction zone. The region of the flow, which is upstream of the constriction, within the pressure modulator, is the pressure space. The constriction ratio is defined as B/A. The pressure space ratio is defined as L1/B. The relative constriction length ratio is defined as L2/A.

The pressure at point 65 is influenced by the constriction ratio, the pressure space ratio and the relative constriction length ratio of the pressure modulator. To effectively influence and modulate the pressure at point 65, flow separation in the pressure space must be minimized, and this generally requires the constriction ratio (B/A) to be greater than about 1.4, the pressure space ratio (L1/B) to be greater than about 0.7 and less than 8.0, and the relative constriction length ratio (L2/A) to be less than about 6.0.

FIGS. 11–16 also show an angle Φ between the shelf of the constriction and the upstream nozzle bore. The magnitude of angle Φ may influence the efficiency of the flow constriction, and therefore the effectiveness of the pressure modulator. For acceptable efficiency, angle Φ should be less than about 135° and, preferably, ranges from about 80° to 100°.

If angle Φ is too large, or too small, the pressure modulator is less able to effect sudden constriction of the flow or a strong pressure gradient, and thus is less able to modulate pressure. If the pressure modulator is unable to modulate pressure, then, as in prior art nozzles, the nozzle would not reduce the pressure differential across a nozzle control zone. A reduced pressure differential decreases corrosive effects and stabilizes the size and shape of the control zone, thereby reducing hunting and increasing flow stability.

Figure 13:
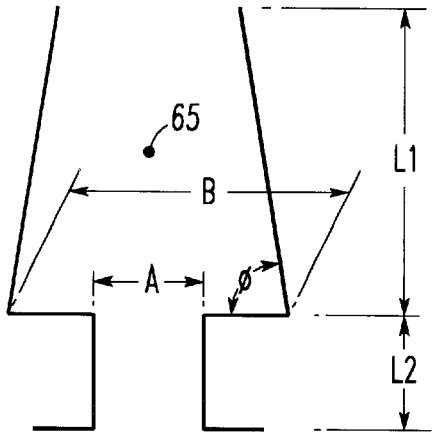
Figure 14:
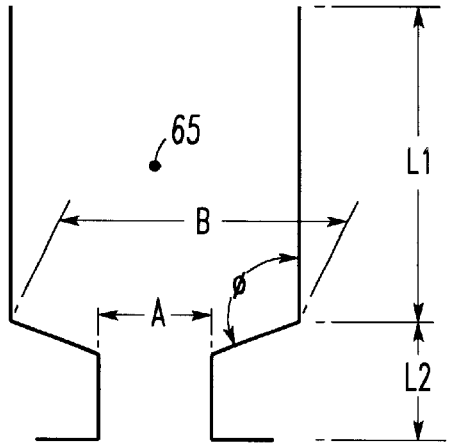
Figure 15:
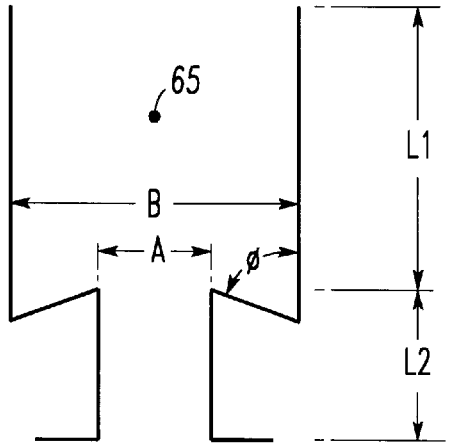

For example, if angle Φ is too small, when a nozzle is configured as in FIG. 13, where the walls of the pressure modulator upstream of the constriction expand toward the constriction zone, pressure modulation may suffer because within the pressure space severe flow separation can occur. Flow separation in the pressure space decreases the ability of the pressure modulator to modulate pressure. Similarly, if angle Φ is too small, when a nozzle is configured as in FIG. 15, severe flow separation can occur within the pressure space. Decreases in angle Φ increase the risk of flow separation.

Figure 16:
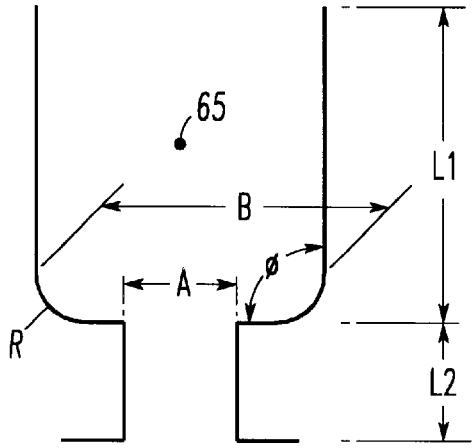

FIG. 16 also shows a radius R between the top shelf of the constriction and the upstream nozzle bore. Also, for acceptable efficiency and effectiveness, radius R must be less than (B−A)/2, and preferably less than (B−A)/4.

The flow of liquid metal 10 enters into the pressure modulator proximate to the portion defining length L1, which has a general size B, such that the ratio L1/B ranges from about 0.7 to 8.0, a preferred range being from about 1.0 to 2.5. The flow is constricted at the shelf 135 of the pressure modulator portion 130, the general size B reducing down to size A. The ratio of B/A should be greater than about 1.4 and, preferably ranges from about 1.7 to 2.5. As discussed above, the shelf defines angle Φ between the shelf and the upstream bore of the pressure modulator. Angle Φ must be less than about 135° and, preferably, ranges from about 80° to 100. The constriction of the pressure modulator has a length L2, where a ratio of L2/A is less than about 6.0, preferably ranging from about 0.3 to 0.5.

Figure 17:
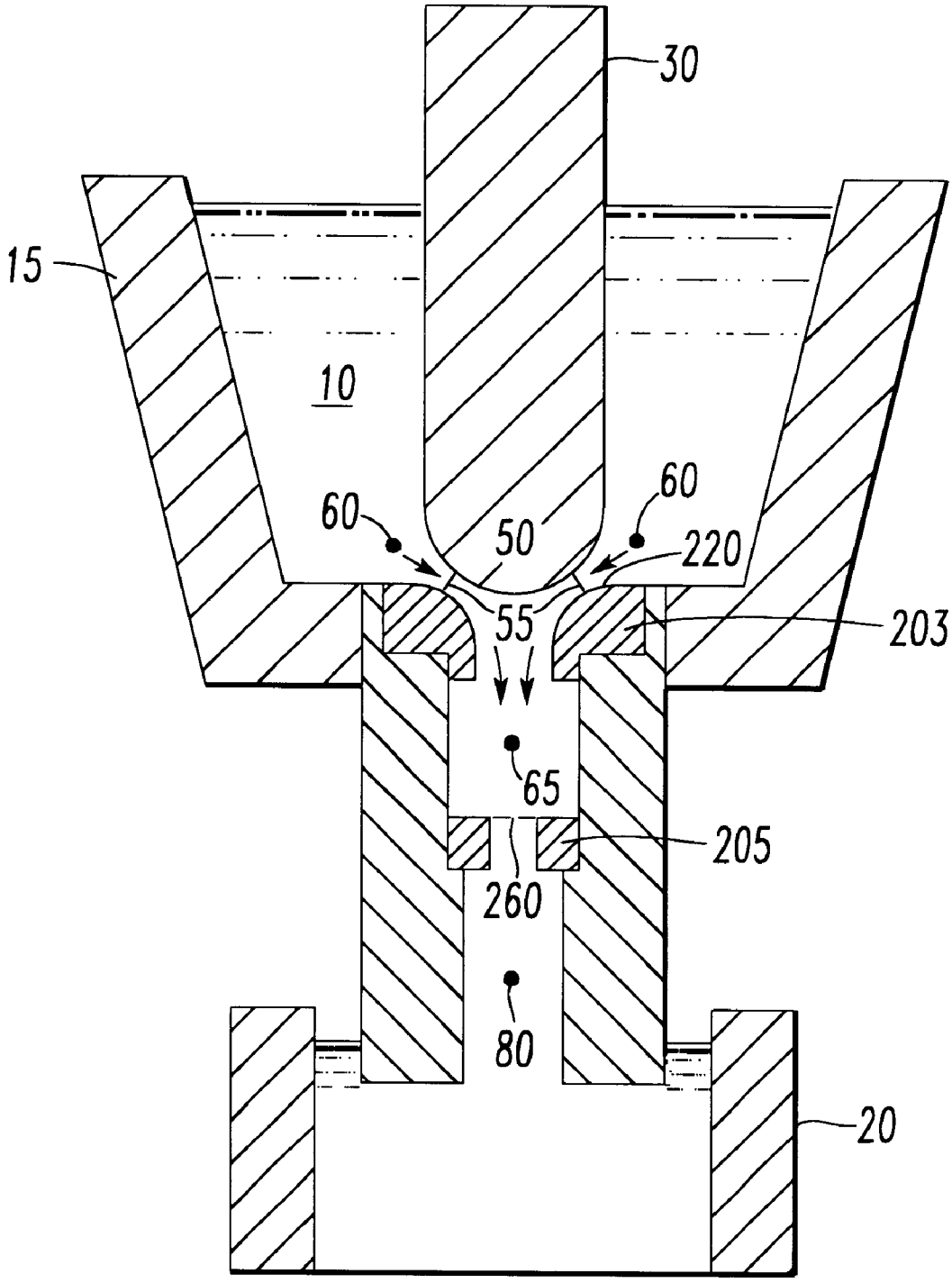
FIG. 17 is a schematic view of a liquid metal flow system incorporating a second embodiment of the continuous casting nozzle according to present invention.
Figure 18:
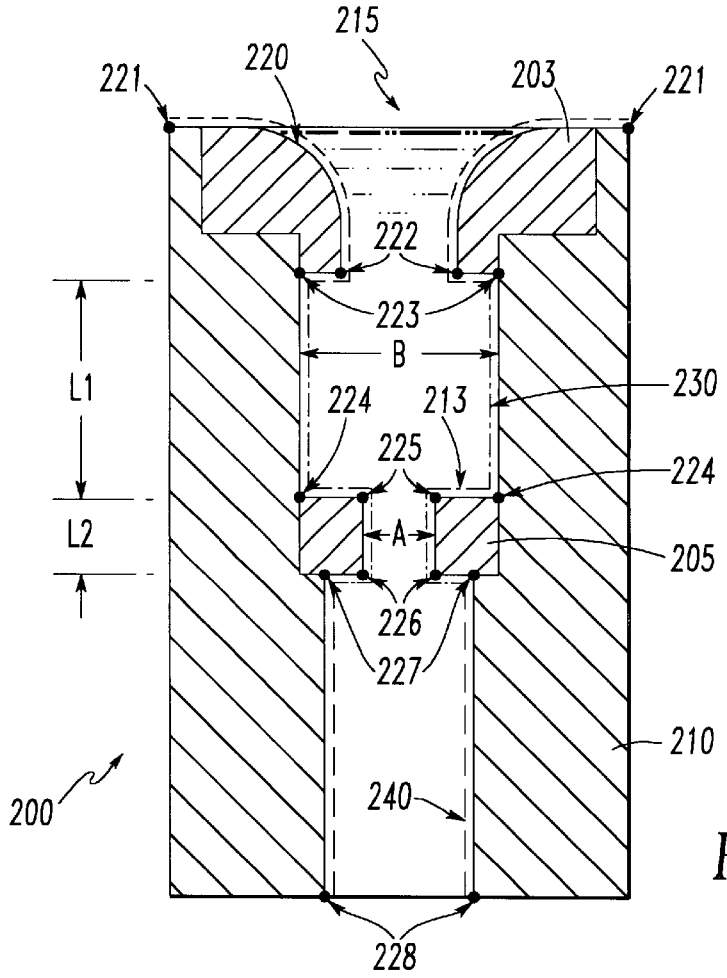
FIG. 18 is a partial schematic view, drawn to an enlarged scale, of the entry portion, pressure modulator and lower portion of the embodiment of FIG. 17.
Figure 19:
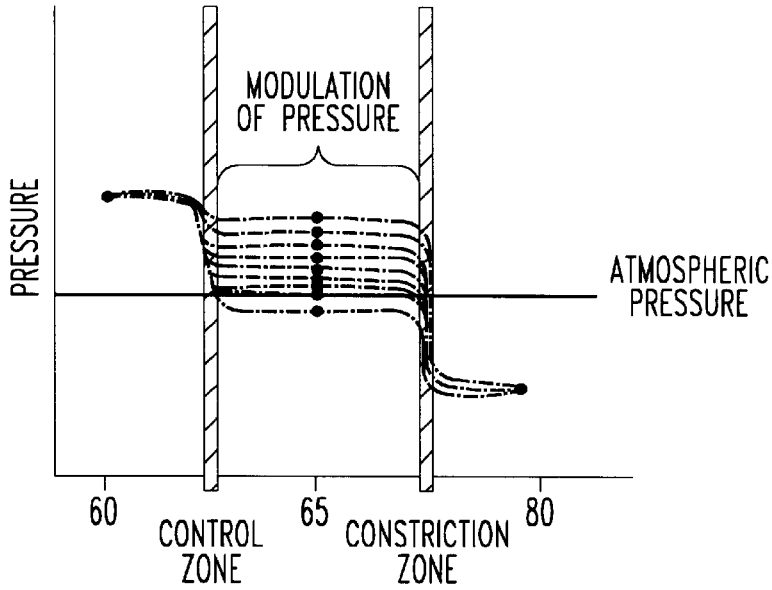
FIG. 19 is a graphical view of the fluid pressure of liquid metal flowing through the embodiment of FIG. 17.
Figure 20:
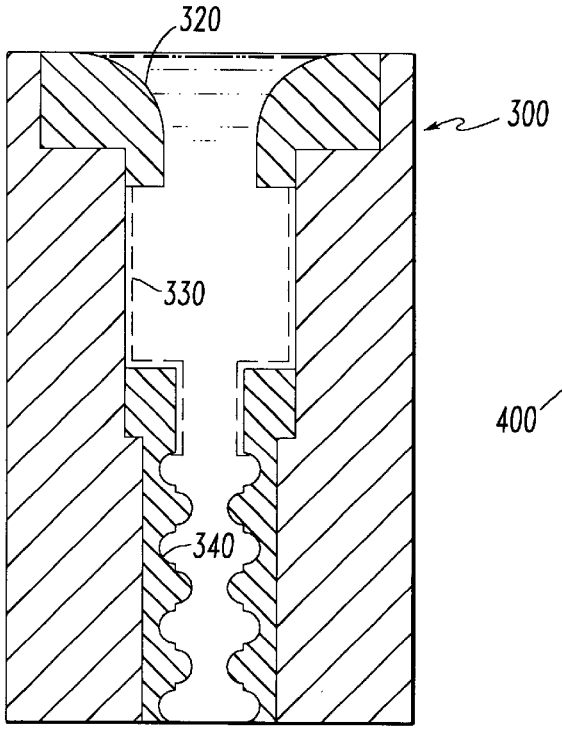
FIGS. 20–26 are partial schematic views of alternative entry portions and lower portions of the nozzle bore of the continuous casting nozzle of the present invention.
Figure 21:
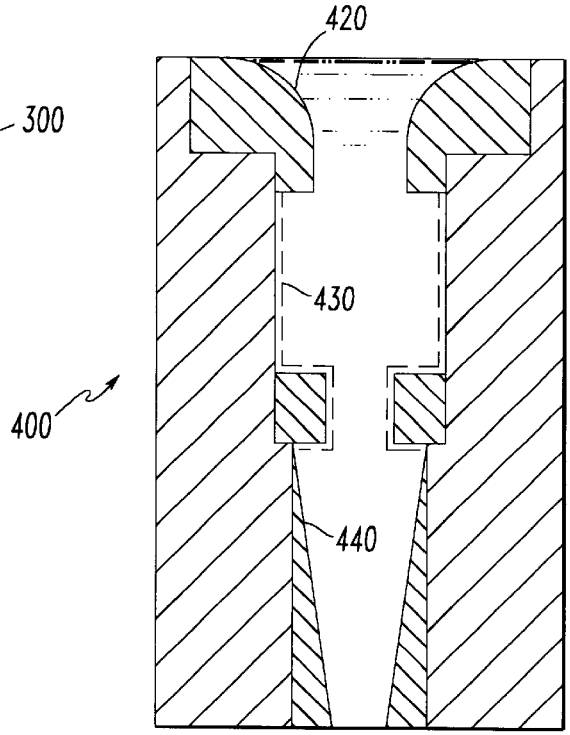
Figure 22:
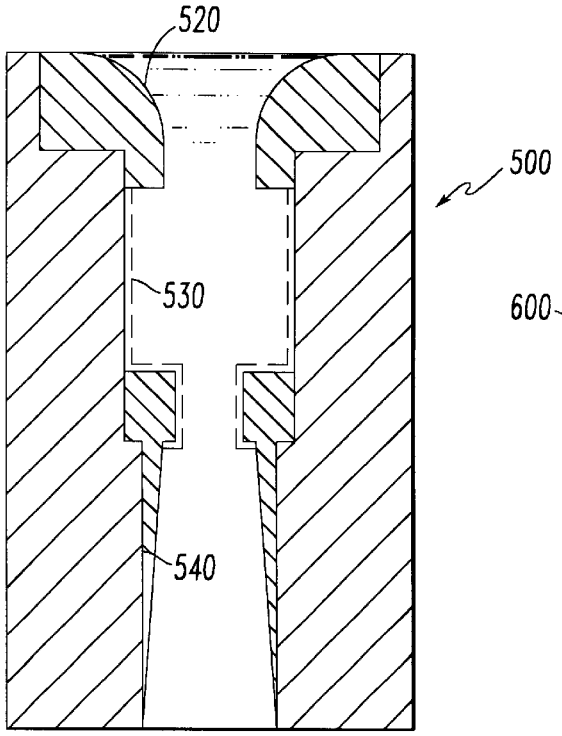
Figure 23:
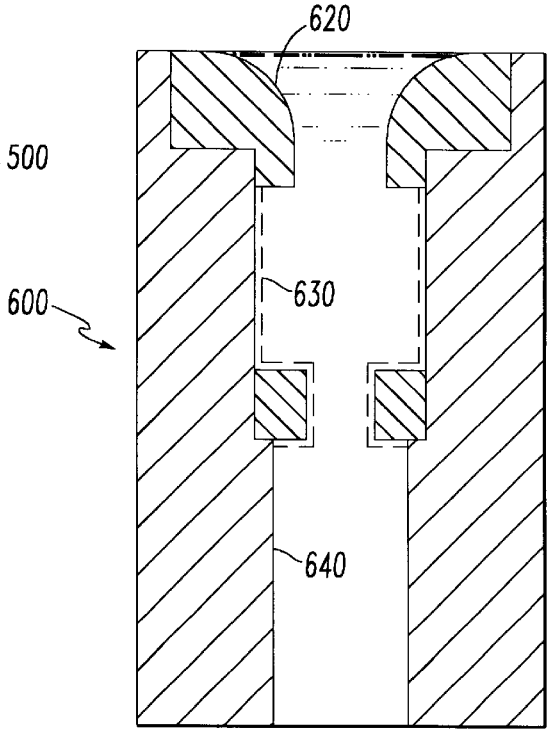

FIG. 17 shows a second liquid metal flow system, from a tundish 15 to a mold 20, that incorporates a second embodiment of the nozzle 200 according to the present invention. As shown in FIG. 18, nozzle 200 includes three components: an entry insert 203, a pressure modulator insert 205 and a main body 210. Like nozzle 100, nozzle 200 has a bore 215 that is divided into three portions: an entry portion 220, extending from point 221 to point 223; a pressure modulator portion 230, extending from point 223 to point 227; and a lower portion 240, extending from point 227 to point 228. The entry insert 203 is separate from the pressure modulator insert 205 because each wears at different rates. The entry insert 203 and the pressure modulator insert 205 may be replaced independently as needed.

Like the pressure modulator 130, the pressure modulator 230 generates sudden, strong fluid compression, which minimizes the pressure differential across and corrosion of the control zone of the nozzle 200 and ultimately increases flow stability.

Figure 24:
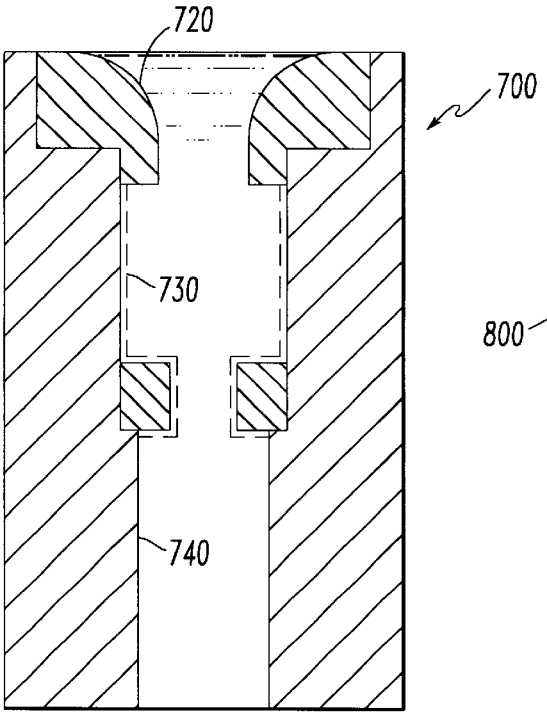
Figure 25:
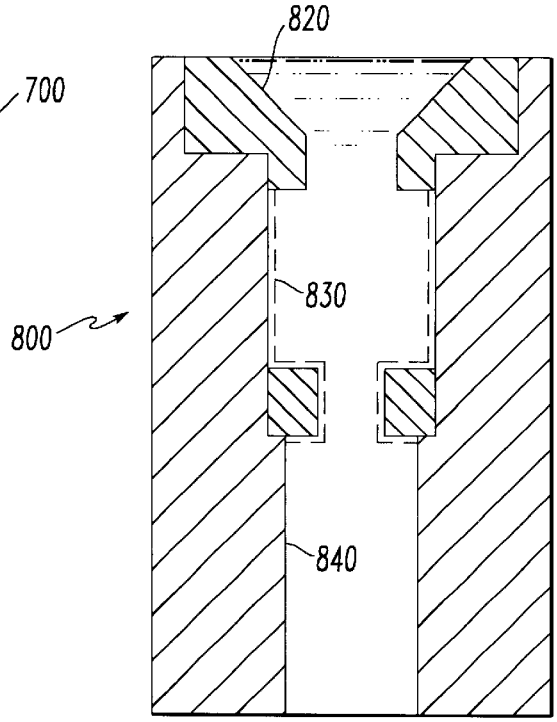
Figure 26:
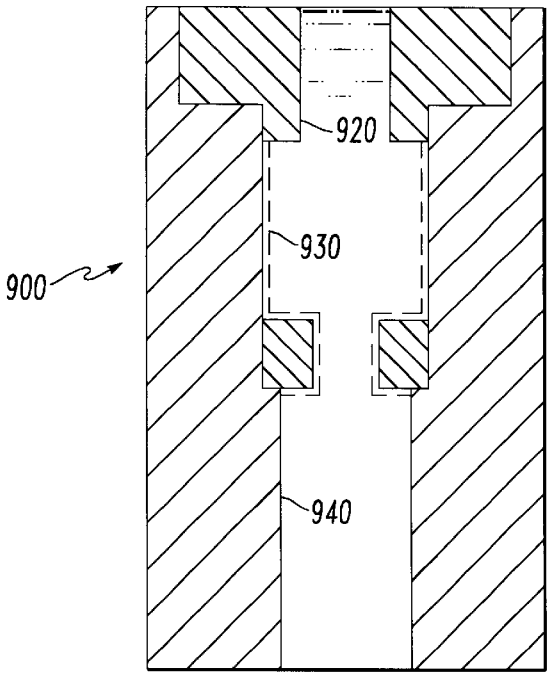

The present invention also may assume the configurations of FIGS. 20–26, all of which include nozzles 300, 400, 500, 600, 700, 800 and 900, which provide for pressure modulation as described above. Each of the nozzles 300, 400, 500, 600, 700, 800 and 900 has three portions which correspond to the three portions of FIGS. 8 and 17: an entry portion 320, 420, 520, 620, 720, 820 or 920; a pressure modulator portion 330, 430, 530, 630, 730, 830 or 930; and a lower portion 340, 440, 540, 640, 740, 840 or 940. FIGS. 20–23 show embodiments with post modulation lower portions of different configurations for various purposes. FIGS. 24–26 show embodiments with pre-modulation entry portions of different configurations for various purposes. So long as the pressure modulator is as described above, various post or pre-modulation configurations will obtain the beneficial effects provided thereby.

Although the present invention has been described in relation to particular embodiments thereof, many other variations and modifications and other uses will become apparent to those skilled in the art. The present invention is not to be limited by the specific disclosure herein.

What is claimed is:

1. A nozzle for transferring a flow of liquid metal in a flow direction and adapted for use with a regulator that controls the flow of liquid metal, the nozzle comprising:

(a) an inner surface defining a throughflow bore for transferring the liquid metal;

(b) an entry portion adapted to cooperate with the regulator and defining a control zone between the entry portion and the regulator; and (c) a pressure modulator downstream of the control zone and adapted to reduce a pressure differential across the control zone, the pressure modulator comprising a side aligned with the flow direction and a bottom generally orthogonal to the flow direction, the side and bottom defining an angle ϕ, wherein the angle ϕ is less than about 135°.

2. The nozzle of claim 1, wherein the regulator is a stopper rod.

3. The nozzle of claim 1, wherein the pressure modulator comprises an insert mounted in the bore of the nozzle.

4. The nozzle of claim 3, wherein the insert defines the entry portion and includes at least one constriction zone for constricting the flow downstream of the entry portion and the pressure modulator.

5. The nozzle of claim 4, wherein the constriction zone has a length "L2" aligned with the flow direction and a width "A" orthogonal to the flow direction, and the pressure modulator portion has a length "L1" aligned with the direction and a width "B" orthogonal to the direction.

6. The nozzle of claim 5, wherein the width "B" divided by the width "A" defines a constriction ratio "B/A" and wherein the length "L1" divided by the width "B" defines a pressure space ratio "L1/B," and wherein the length "L2" divided by the width "A" defines a relative constriction length ratio "L2/A," the ratios being selected to reduce flow separation.

7. The nozzle of claim 5, wherein the width "B" divided by the width "A" defines a constriction ratio "B/A" which is greater than about 1.4.

8. The nozzle of claim 5, wherein the width "B" divided by the width "A" defines a constriction ratio "B/A" which ranges from about 1.7 to 2.5.

9. The nozzle of claim 5, wherein the length "L1" divided by the width "B" defines a pressure space ratio "L1/B" which is greater than about 0.7 and less than about 8.0.

10. The nozzle of claim 5, wherein the length "L1" divided by the width "B" defines a pressure space ratio "L1/B" which ranges from about 1.0 to 2.5.

11. The nozzle of claim 5, wherein the length "L2" divided by the width "A" defines a relative constriction length ratio "L2/A" which is less than about 6.0.

12. The nozzle of claim 5, wherein the length "L2" divided by the width "A" defines a relative constriction length ratio "L2/A" which ranges from about 0.3 to 1.5.

13. The nozzle of claim 1, wherein the angle $\phi$ ranges from about 80° to 100°.

14. A The nozzle of claim 1, wherein the side and the bottom define a radius R therebetween which is less than about (B−A)/2.

15. The nozzle of claim 14, wherein the radius R is less than about (B−A)/4.

16. A nozzle for transferring a flow of liquid metal in a flow direction and adapted for use with a regulator that controls the flow of liquid metal, the nozzle comprising:

(e) an inner surface defining a throughflow bore for transferring the liquid metal;

(f) an entry portion adapted to cooperate with the regulator and defining a control zone between the entry portion and the regulator;

(g) a pressure modulator downstream of the control zone and adapted to reduce a pressure differential across the control zone, the pressure modulator comprising a side aligned with the flow direction and a bottom generally orthogonal to the flow direction, the side and the bottom defining an angle $\phi$, wherein the angle $\phi$ is less than about 135°; and (h) at least one constriction zone for constricting the flow downstream of the entry portion and the pressure modulator.

* * * * *